US006305480B1

(12) United States Patent
Franklin

(10) Patent No.: US 6,305,480 B1
(45) Date of Patent: Oct. 23, 2001

(54) POST DRIVING AND EARTH BORING MACHINE

(76) Inventor: Steven D. Franklin, 820 Sumac Rd., Christiansburg, VA (US) 24073

( * ) Notice: Subject to any disclaimer, the term of this patent is extended or adjusted under 35 U.S.C. 154(b) by 0 days.

(21) Appl. No.: 09/544,604

(22) Filed: Apr. 6, 2000

Related U.S. Application Data

(60) Provisional application No. 60/129,228, filed on Apr. 14, 1999.

(51) Int. Cl.[7] ..... B25D 9/00; E21B 7/02

(52) U.S. Cl. ..... 173/27; 173/28; 173/184; 173/193; 173/89; 173/147

(58) Field of Search ..... 173/1, 25, 27, 173/28, 31, 39, 81, 86, 89, 147, 184, 185, 195, 196, 193; 405/232

(56) References Cited

U.S. PATENT DOCUMENTS

| | | | | |
|---|---|---|---|---|
| 3,333,646 | * | 8/1967 | Hoen et al. | 173/27 |
| 3,400,771 | * | 9/1968 | Dorn | 173/28 |
| 3,490,548 | * | 1/1970 | Lake | 173/86 |
| 3,576,218 | * | 4/1971 | Lisenby | 173/28 |
| 3,658,139 | * | 4/1972 | Von Ruden | 173/124 |
| 4,050,526 | | 9/1977 | Deike . | |
| 4,124,081 | | 11/1978 | Deike . | |
| 4,263,975 | | 4/1981 | Dagnaud . | |
| 5,282,511 | | 2/1994 | Burenga et al. . | |
| 5,291,955 | | 3/1994 | Clark . | |
| 5,607,022 | * | 3/1997 | Walker et al. | 173/89 |

FOREIGN PATENT DOCUMENTS

| | | |
|---|---|---|
| 560857 | 4/1975 | (CH) . |
| 1098644 | 1/1968 | (GB) . |

* cited by examiner

*Primary Examiner*—Scott A. Smith
(74) *Attorney, Agent, or Firm*—Richard C. Litman

(57) ABSTRACT

A machine for driving posts, drills, large spikes, and the like work pieces into the ground, pavements, or wall structures. The machine comprises an elongated tower, a carriage, a hammer, a combination of an elongated two-way cylinder and a pulley system, at least one control valve box, a plurality of hydraulic pressurized lines, a plurality of hydraulic conduits, and a plurality of fasteners. The tower has two parallel rails for the hammer to slide upward, and then downward so as to exert a force upon the work piece toward a work surface. The machine may further include two two-way cylinders, a hammer guide, constraining springs and an interchangeable plate.

12 Claims, 10 Drawing Sheets

POST DRIVING AND EARTH BORING MACHINE

CROSS-REFERENCE TO RELATED APPLICATION

This application claims the benefit of U.S. Provisional Patent Application Serial No. 60/129,228, filed Apr. 14, 1999.

BACKGROUND OF THE INVENTION

1. Field of the Invention

The present invention relates generally to a hydraulic hammer. More specifically, the invention is a machine for driving posts, drills, large spikes, and the like work pieces into the ground, pavements, or wall structures.

2. Description of Related Art

A number of practices and devices have been devised for driving posts, drills, large spikes, and similar work pieces into the ground, pavements, or wall structures.

For example, U.S. Pat. No. 4,050,526 issued on Sep. 27, 1977 and U.S. Pat. No. 4,124,081 issued on Nov. 7, 1978 to Deike generally disclose a portable hydraulic actuated machine for driving posts and the like work pieces into the ground, pavements, or wall structures. The machine includes an automotive vehicle which is easily transported to the work site and which carries a turntable supporting an upstanding tower on which rides a carriage slidably mounting a spring loaded heavy hammer, a work piece engaging spring loaded anvil struck by the hammer, and a hydraulic hammer lifting mechanism.

U.S. Pat. No. 4,263,975 issued on Apr. 28, 1981 to Dagnaud discloses a device for high-speed boring of stepped post-holes comprising a bearing sleeve, a support frame adapted to carry the bearing sleeve, a cylindrical cutter placed around a boring mandrel attached to the operating rod of a jack, and a means carried by the boring mandrel for removing the portion of soil which is trapped between the cylindrical cutter and the boring mandrel.

U.S. Pat. No. 4,382,475 issued on May 10, 1983 to Suzuki discloses a hydraulic hammering apparatus wherein an upwardly opened fluid chamber is accommodated in a vertically movable manner within a longitudinally cylinder having a weight holding portion formed on the upper part of its top plate. The back of the top plate of the cylinder is sealedly connected with the opening of the fluid chamber by means of a diaphragm.

U.S. Pat. No. 5,282,511 issued on Feb. 1, 1994 to Burenga et al. discloses a bearing block for use in providing a bearinged relationship between the carriage and reciprocal moving driving ram of a post driver. The carriage includes a pair of channel forming bearing surfaces between these two operating components so as to disseminate the impacting forces exerted through the bearings while the driving ram continuously pounds a fence or other post into the ground.

U.S. Pat. No. 5,291,955 issued on Mar. 8, 1994 to Clark discloses a self-contained hydraulic hammer which is capable of traveling in either forward or reverse directions and is provided with liftable weights to which a tool for digging or breaking up a surface is attached. The hydraulic hammer is equipped with time delay controls.

Great Britain Patent No. 1,098,644, published Jan. 10, 1968, discloses a piling equipment comprising an upwardly extending jib or boom non-adjustably fixed to a mobile vehicle and a piling mast connected to the boom for adjustment at will relatively thereto.

The prior art fails to teach a post driving and boring machine that enables an operator to simply, efficiently, and effectively extend the machine a sufficient distance away from a vehicle transporting the machine, operate the machine at several different angles, and operate the machine with a variety of attachment tools. None of the above inventions and patents, taken either singly or in combination, is seen to describe the instant invention as claimed.

SUMMARY OF THE INVENTION

A machine and a method of using the machine for driving posts, drills, large spikes, and the like similar pieces into the ground, pavements, or wall structures. The machine comprises an elongated tower, a carriage, means for attaching the carriage to the tower, a hammer, hydraulic means for raising and lowering the hammer, means for transporting hydraulic fluid, and means for controlling the flow of hydraulic fluid.

The elongated tower includes an upper end, a lower end, two parallel rails, a plate structure, and a carriage receiving structure. Each of the rails has a channel parallel to each of the corresponding rails, and the rails are positioned such that the channels of the rails face one another. The receiving structure has a top side, a front side, and a back side. The back side of the receiving structure has a receiving channel for receiving the carriage.

The carriage includes a first end, a second end, a universal joint, and a hollow cylinder for receiving the joint. The first end of the carriage attaches to a hydraulic means for raising and lowering the tower. The second end of the carriage slides into the receiving channel. The joint has a plate with three holes. The hollow cylinder receives the joint, and has a plate with three holes that is adapted to make contact with the plate of the joint.

The hammer has a top side, a bottom side, a front side, a back side, a first side, a second side, a chamber defined within the sides of the hammer, and sufficient rigidity and strength to exert a sufficient downward force on the work piece. Each of the first and second sides of the hammer has two roller bearings and a roller bearing guide for the hammer to slide within the rails of the tower.

The hydraulic means for raising and lowering the hammer is a combination of an elongated two-way cylinder and a pulley system. The elongated cylinder and pulley system combination reciprocates between a first position with the pulley being closest to the lower end of the tower, and a second position with the pulley being farthest from the lower end of the tower. When the combination is in the second position, the hammer is positioned about the upper end of the tower.

The machine may further include a hydraulic means for tilting the tower. The hydraulic means for tilting the tower is two two-way cylinders with each of the two-way cylinders having a first end, a second end, an inlet, and an outlet. Each of the two-way cylinders reciprocates between a first position with the second end of the corresponding two-way cylinder being farthest from the tower, a second, or neutral, position with the second end of the corresponding two-way cylinder being second farthest from the tower, and a third position with the second end of the corresponding two-way cylinder being closest to the tower.

The means for transporting hydraulic fluid are a plurality of hydraulic pressurized lines and a plurality of hydraulic conduits.

The means for controlling flow of hydraulic fluid are two control valve boxes. The first box includes two inlets, two outlets, a first lever for controlling fluid flow to a first two-way cylinder, and a second lever for controlling fluid flow to a second two-way cylinder. Each of the inlets of the first box is securely connected to an outlet of the corresponding two-way cylinder by a first or second hydraulic pressurized line. Each of the outlets of the first box is securely connected to an inlet of the corresponding two-way cylinder by a third or fourth hydraulic pressurized line.

The second box includes an inlet, an outlet, and a lever for controlling fluid flow to the elongated cylinder. The inlet of the second box is securely connected to the outlet of the elongated cylinder by a hydraulic pressurized line. The outlet of the second box is securely connected to the inlet of the elongated cylinder by a hydraulic pressurized line.

The machine may further include a dampening means between the hammer and the work piece, comprising a hammer guide. Wherein the hammer guide has a first side and a second side having two roller bearings for sliding within the channels of the rails. The machine may further include an interchangeable plate for attaching the work piece.

Accordingly, it is a principal object of the invention to provide a machine and a method of using the machine for driving posts, drills, large spikes, and the like work pieces into the ground, pavements, or wall structures.

It is another object of the invention to provide a machine for driving posts, drills, large spikes, and the like work pieces into the ground, pavements, or wall structures that may be extended a sufficient distance away from the vehicle transporting the device.

It is a further object of the invention to provide a machine for driving posts, drills, large spikes, and the like work pieces into the ground, pavements, or wall structures that may operate at several different angles.

Still another object of the invention is to provide a machine for driving posts, drills, large spikes, and the like work pieces into the ground, pavements, or wall structures that may be operated with a variety of attachment tools.

It is an object of the invention to provide improved elements and arrangements thereof in a machine for the purposes described which is efficient, dependable, and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1A:
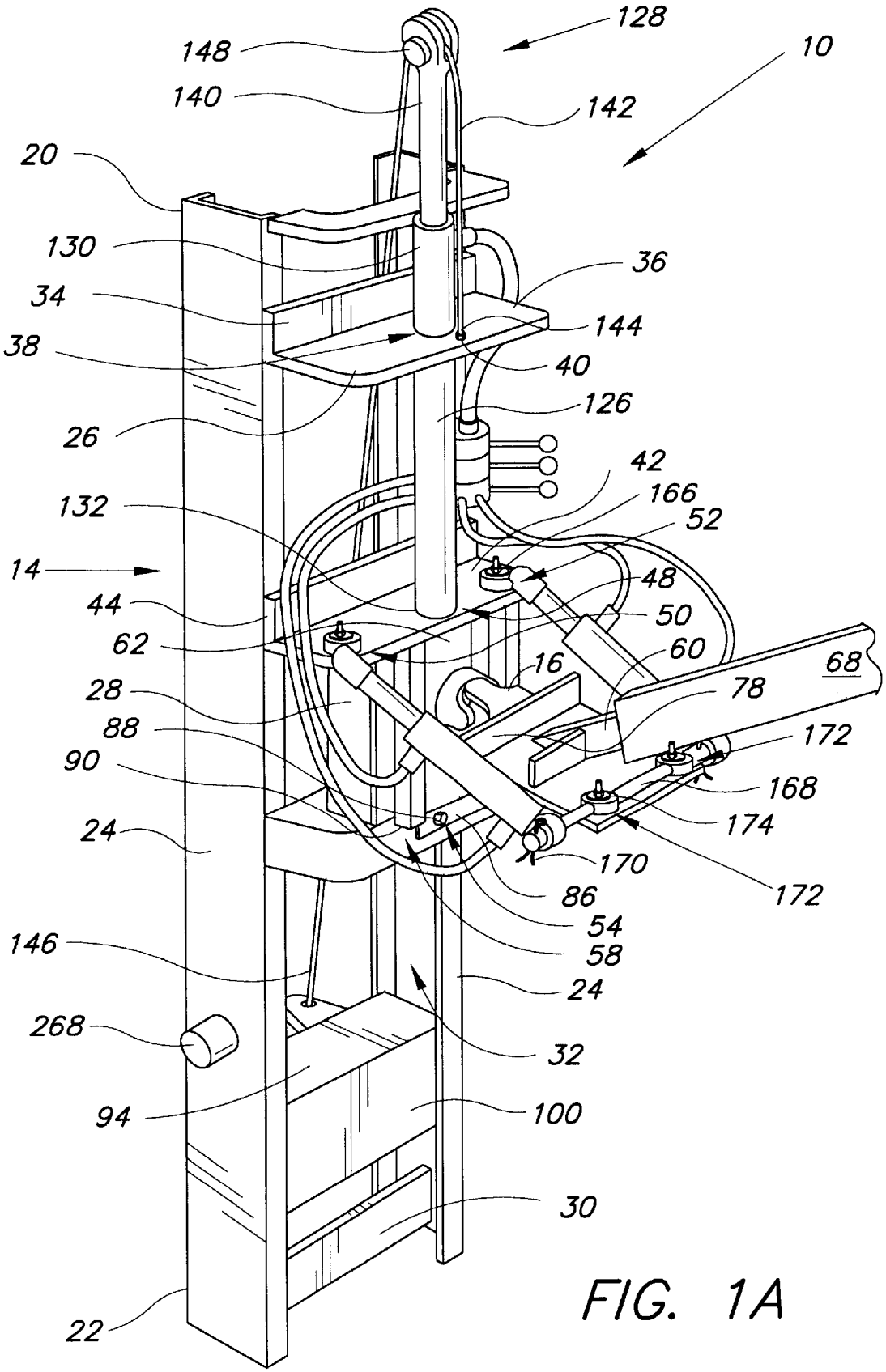
FIGS. 1A and 1B are perspective rear views of a post driving and earth boring machine according to the present invention, wherein hydraulic means for raising and lowering a hammer is in a first position.

Referring to FIGS. 1A–9, the present invention is directed to a machine 10 and a method of using the machine 10 for driving posts, drills, large spikes, and the like work pieces 12 into the ground, pavements, or wall structures. The machine 10 comprises an elongated tower 14, a carriage 16, means for attaching the carriage 16 to the tower 14, a hammer 18, hydraulic means for raising and lowering the hammer 18, means for transporting hydraulic fluid, and means for controlling flow of hydraulic fluid.

Figure 1B:
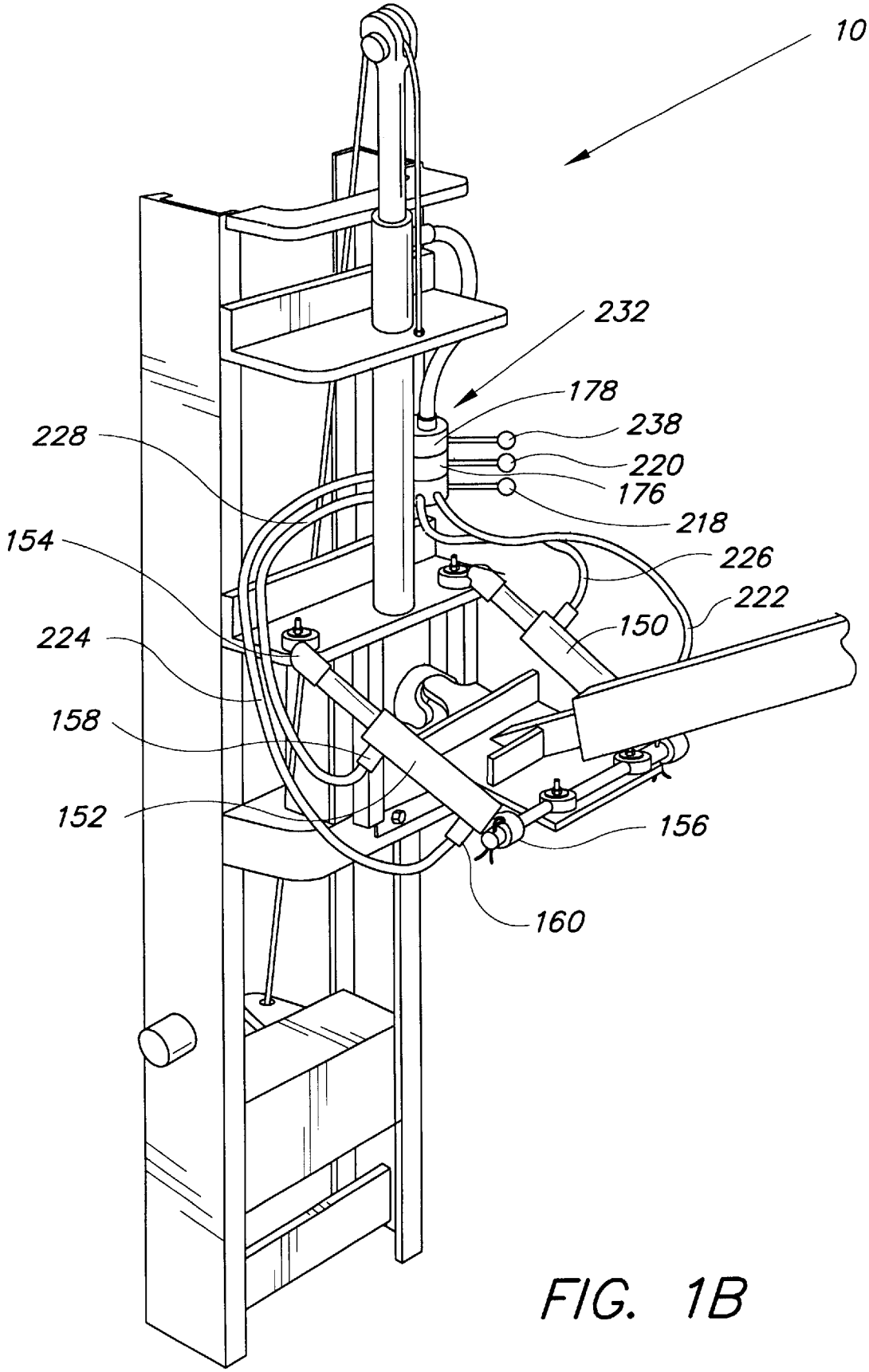
Figure 8:
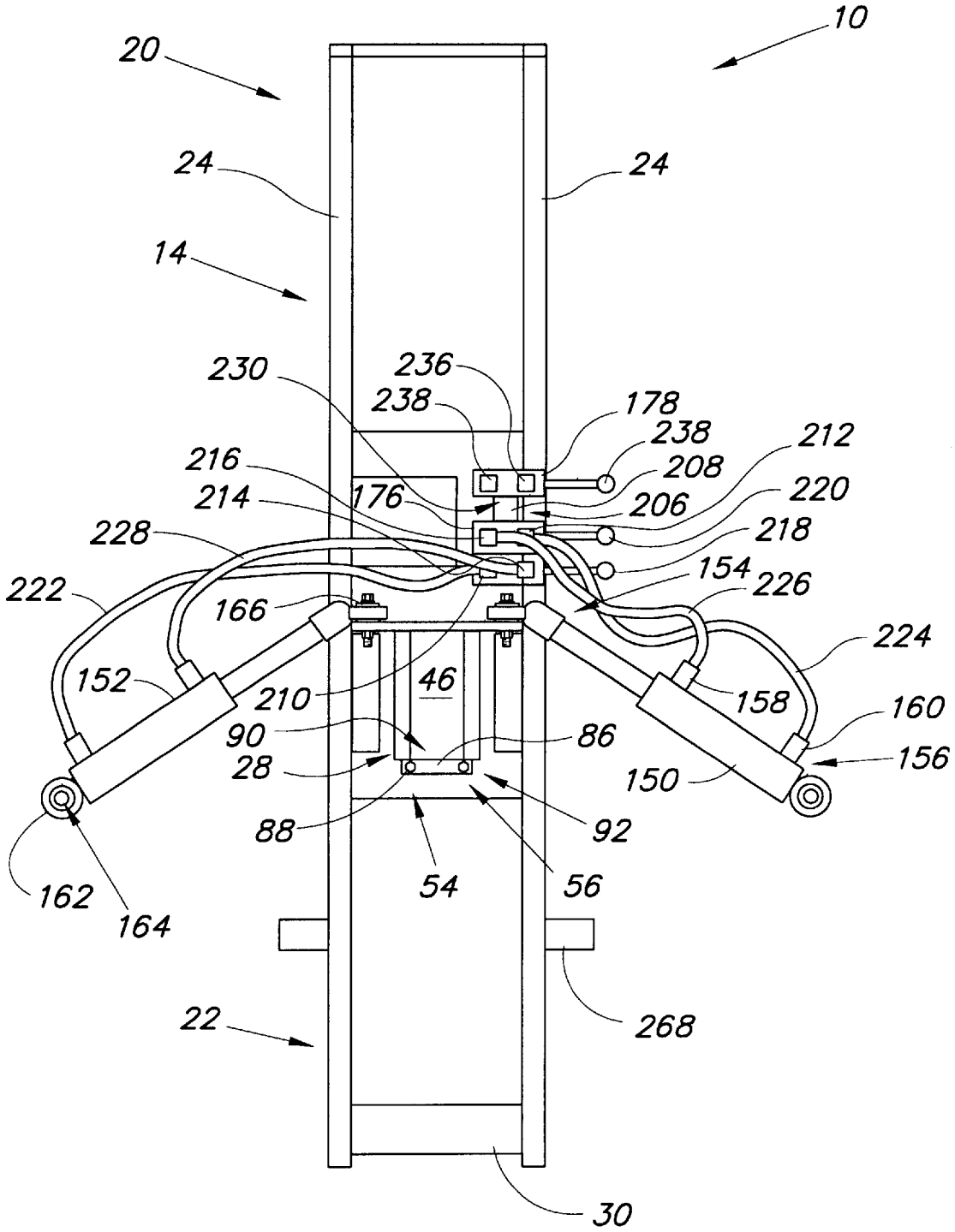
FIG. 8 is a perspective rear view of the post driving and earth boring machine, with a close-up of two two-way cylinders and of a receiving structure of a tower, according to the present invention.

The elongated tower 14 (as shown in FIGS. 1A–3 and 8) is rigid, and includes an upper end 20, a lower end 22, two parallel rails 24, a plate structure 26, and a carriage receiving structure 28. The lower end 22 of the tower 14 has a foot structure 30 to rest the tower 14 on a work surface. Each of the rails 24 has a channel 32 (as shown in FIGS. 1A and 1B) parallel to each of the corresponding rails 24, and the rails 24 are positioned (as best shown in FIGS. 1A and 1B) such that the channels 32 of the rails 24 face one another. The plate structure 26 (as best shown in FIGS. 1 and 1B) has a front portion 34 and a back portion 36. The front portion 34 is preferably attached to the rails 24 in the position shown in FIG. 1 by any well known process in the art, such as welding, molding, brazing, soldering, etc. The back portion 36 has two openings 38, 40. The receiving structure 28 (as shown in FIGS. 1A, 1B and 8) has a top side 42, a front side 44, and a back side 46. The top side 42 of the receiving structure 28 has three channels 48, 50, 52. The front side 44 of the receiving structure 28 is preferably attached to the rails 24 in the position shown in FIGS. 1A and 1B by any well known process in the art, such as welding, molding, brazing, soldering, etc. The back side 46 of the receiving structure 28 has two holes 54, 56 (as shown in FIG. 8), and a receiving channel 58 (as shown in FIGS. 1A and 1B) for receiving the carriage 16.

Figure 4:
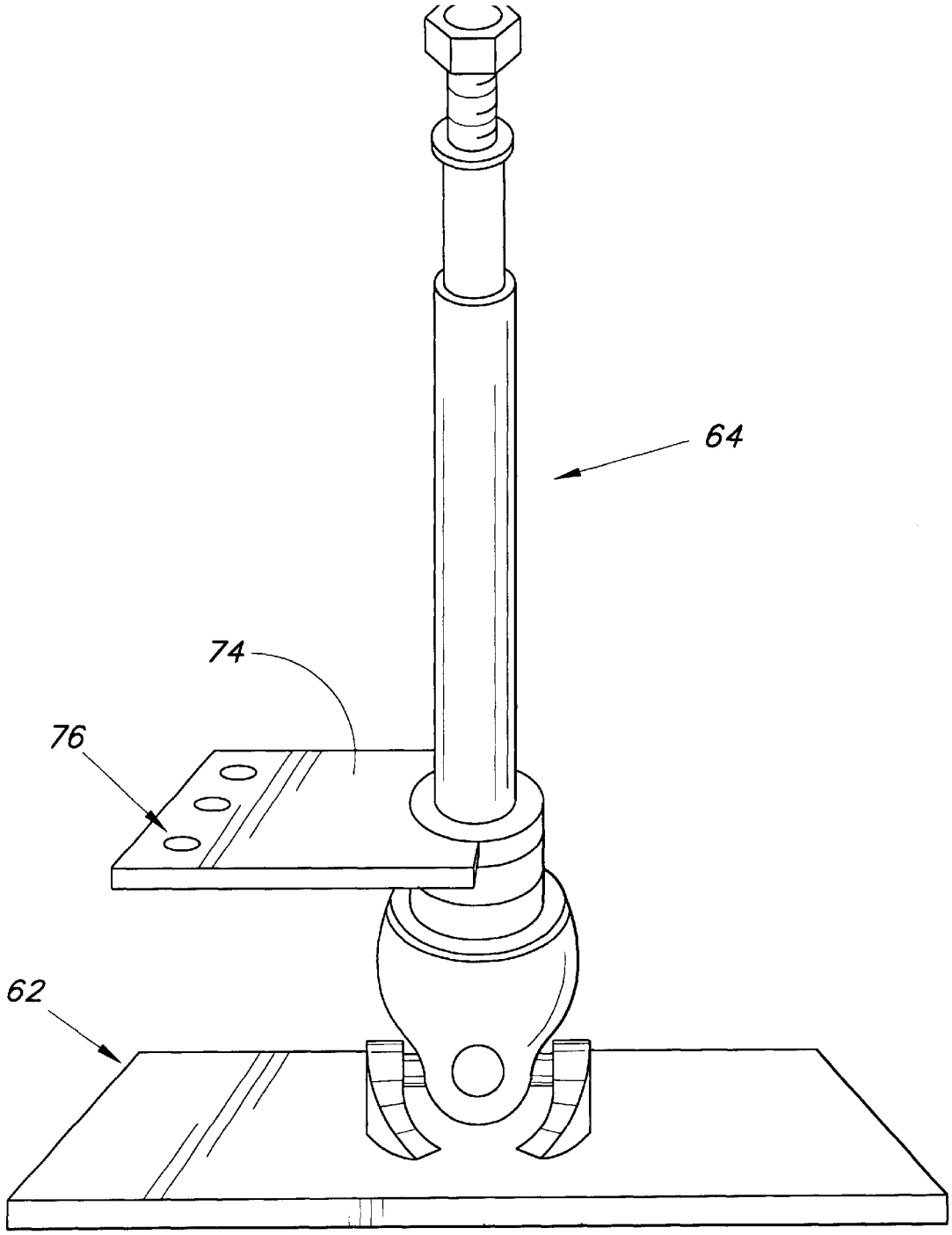
FIG. 4 is a perspective view of an universal joint for a carriage of the post driving and earth boring machine according to the present invention.
Figure 5:
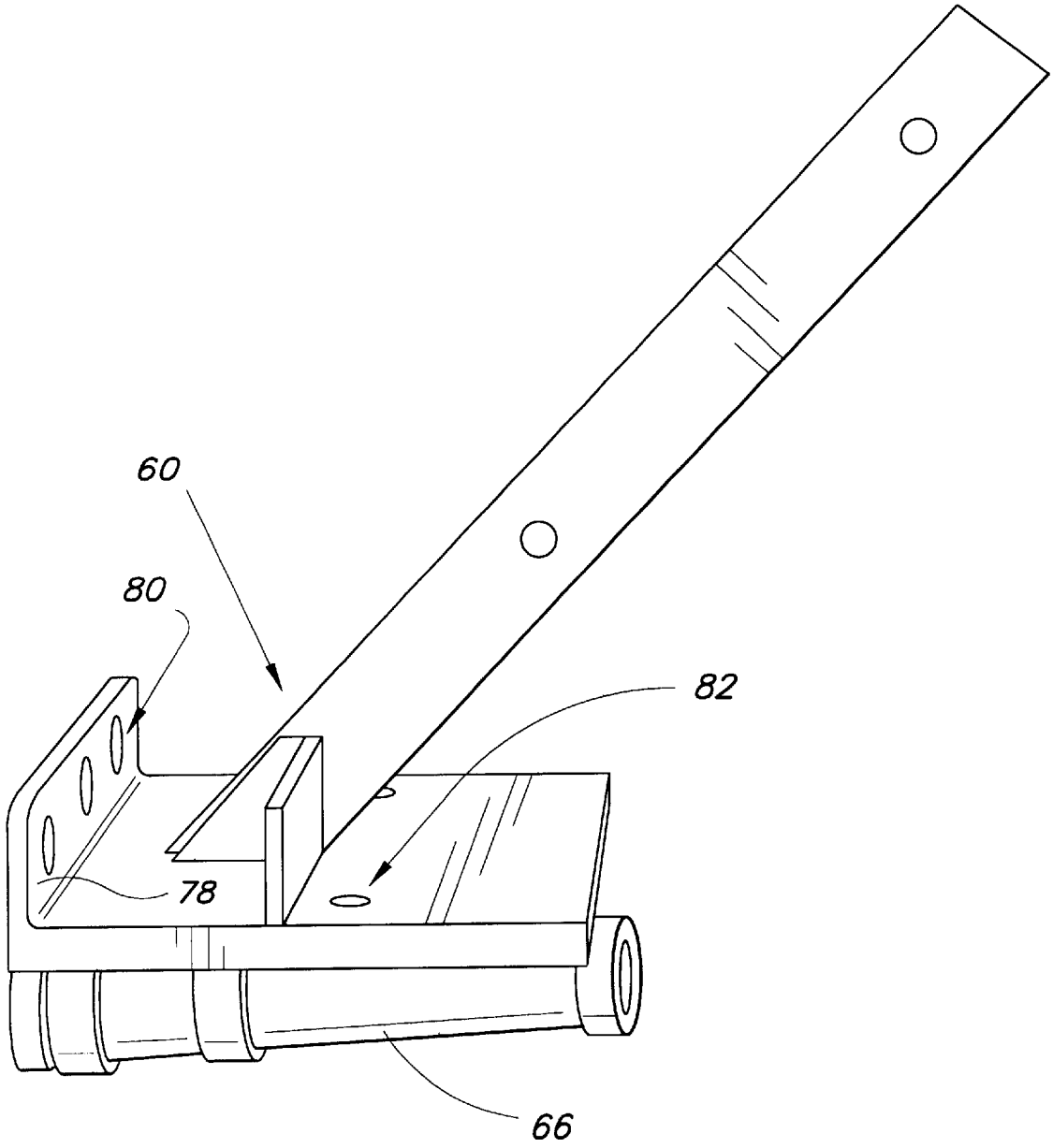
FIG. 5 is a perspective view of a hollow cylinder for the carriage of the post driving and earth boring machine according to the present invention.

As shown in FIGS. 1A, 1B, 4, and 5, the carriage 16 includes a first end 60, a second end 62, a universal joint 64, and a hollow cylinder 66 for receiving the joint 64. The first end 60 (as best shown in FIGS. 1A and 1B) of the carriage 16 is dimensioned and configured to attach to hydraulic means for raising and lowering the tower 14, such as a crane 68 of a truck 70, a backhoe, an excavator, etc. The attachment of the first end 60 of the carriage 16 to the crane 68 may be accomplished by fastener means (not shown), such as a plurality of screws, washers, and nuts. The second end 62 of the carriage 16 is dimensioned and configured to slide into the receiving channel 58. The joint 64 (as shown in FIG. 4) has a plate 74 with three holes 76. The hollow cylinder 66 (as shown in FIG. 5) has an inner diameter that is dimensioned and configured to receive the joint 64, a plate 78 with three holes 80 that is adapted to make contact with the plate 74 of the joint 64, and two holes 82 proximate the second end 62 of the carriage 16. The attachment of the hollow cylinder 66 to the joint 64 at the corresponding holes 76, 80 may be accomplished by fastener means (not shown), such as three screws, three washers, and three nuts.

As shown in FIGS. 1A, 1B and 8, the means for attaching the carriage 16 to the tower 14 is a securing plate 86 and a fastener 88, such as a plurality of screws, washers, and nuts. The securing plate 86 has two ends 90, 92, and is adapted to work in conjunction with the fastener 88 to attach the carriage 16 to the tower 14. The length, defined between the ends 90, 92 of the securing plate 86, of the securing plate 86 is sufficient to support the attachment of the carriage 16 to the tower 14. After the second end 62 of the carriage 16 is slid into the receiving channel 58, the carriage 16 is securely attached to the tower 14 by placing the securing plate 86 below the carriage 16 in the position shown in FIGS. 1A and 1B, and by securing the securing plate 86 to the back side 46 of the receiving structure 28 with the fastener 88.

Figure 6:
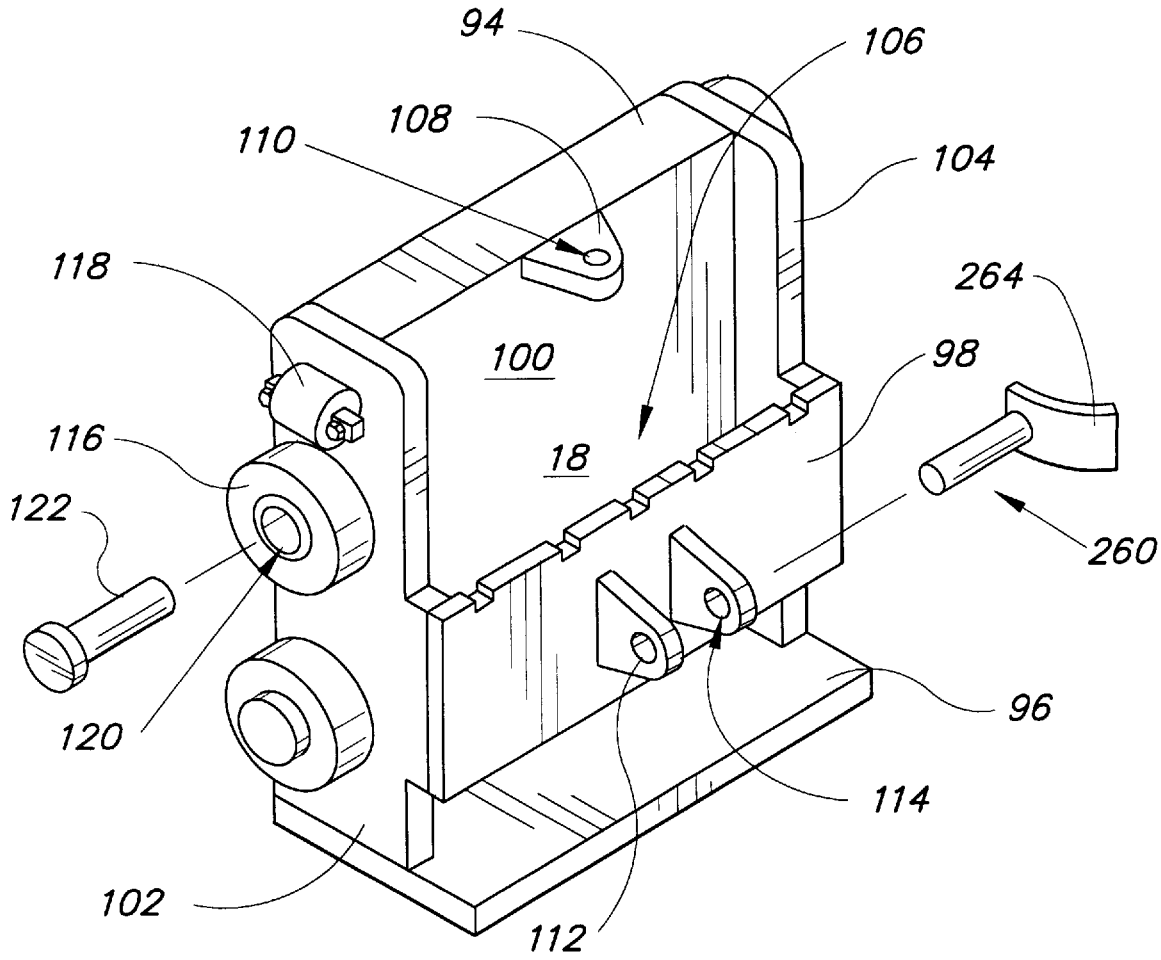
FIG. 6 is a perspective view of the hammer for the post driving and earth boring machine according to the present invention.

As best shown in FIG. 6, the hammer 18, dimensioned and configured to fit within the rails 24, has a top side 94, a bottom side 96, a front side 98, a back side 100, a first side 102, a second side 104, and a chamber 106 defined within the sides 94, 96, 98, 100, 102, 104 of the hammer 18. The top side 94 of the hammer 18 has an abutment 108 with a hole 110. The bottom side 96 of the hammer 18 is adapted for attaching with the work piece 12 such that the work piece 12 is located below the hammer 18, and has sufficient rigidity and strength to exert a sufficient downward force on the work piece 12.

Figure 2:
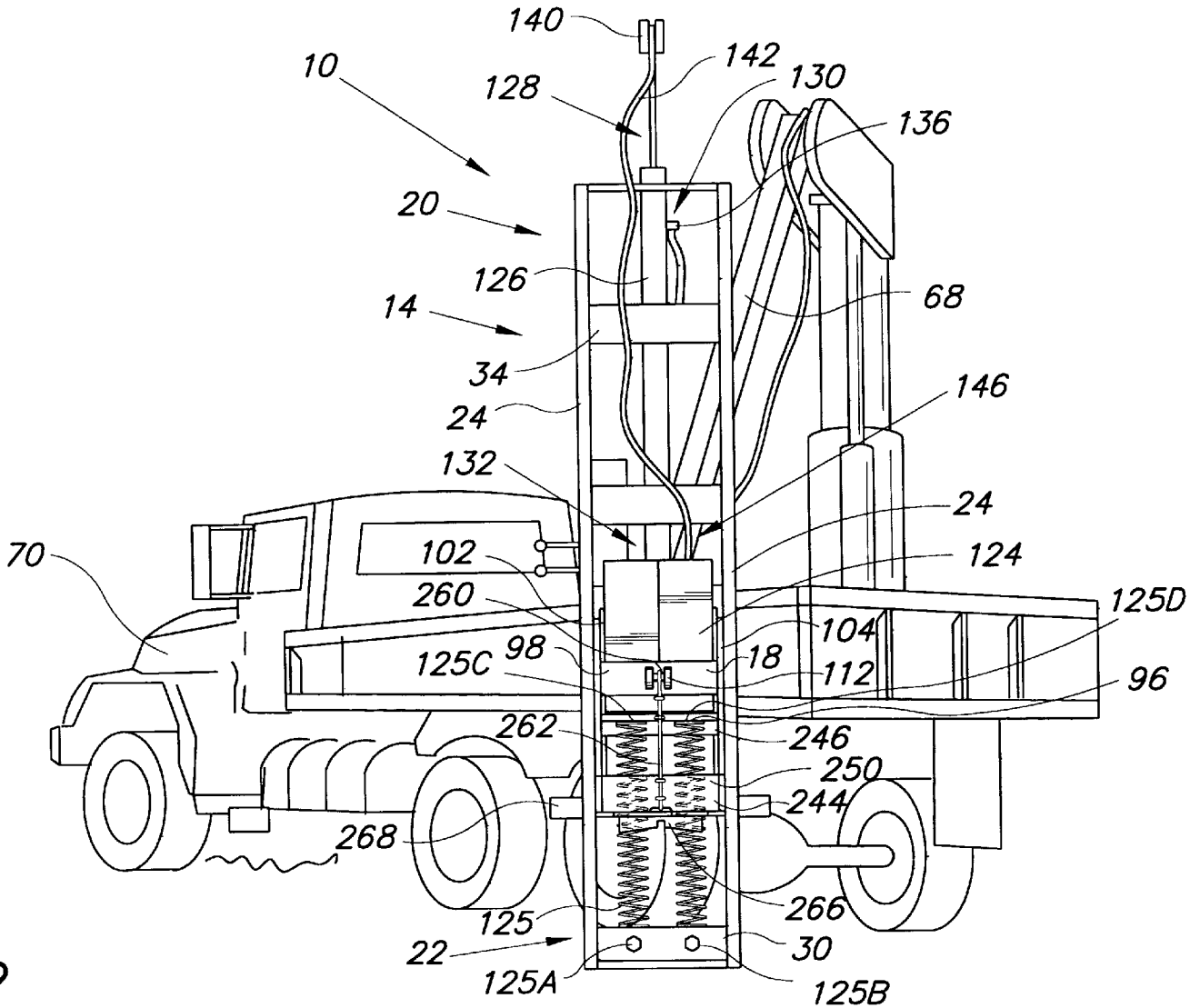
FIG. 2 is a perspective front view of a post driving and earth boring machine according to the present invention, wherein the hydraulic means for raising and lowering the hammer is in the first position.
Figure 3:
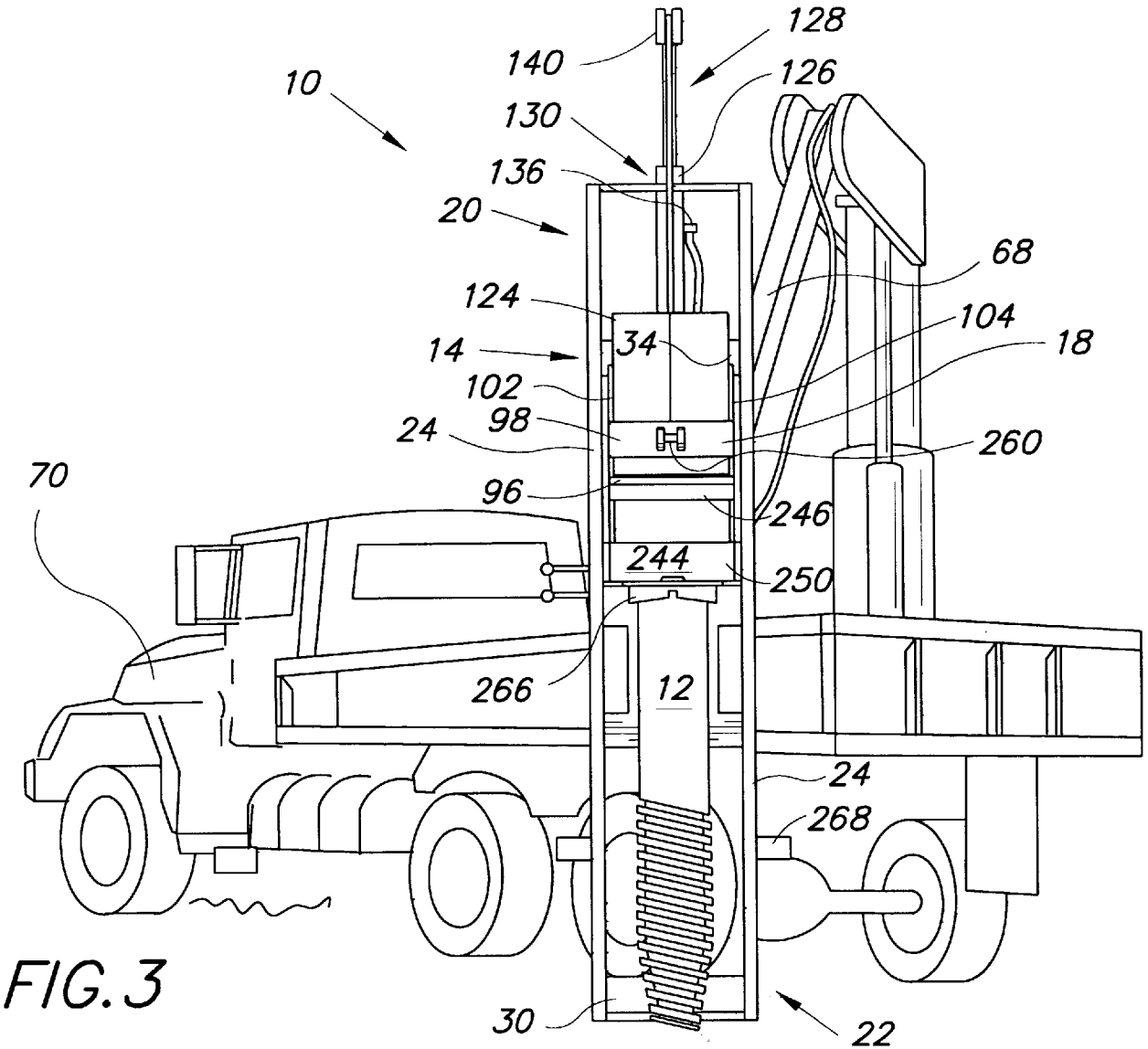
FIG. 3 is a perspective front view of a post driving and earth boring machine according to the present invention, wherein the hydraulic means for raising and lowering the hammer is in a second position.

The attachment of the work piece 12 to the bottom side 96 of the hammer 18 may be accomplished by any well known process in the art. The front side 98 (as shown in FIGS. 2, 3, and 6) of the hammer 18 has two abutments 112 where each of the abutments 112 has a hole 114. Each of the first 102 and second 104 sides of the hammer 18 has two roller bearings 116 and a roller bearing guide 118, preferably in the positions as shown in FIG. 6. Each of the roller bearings 116 of the hammer 18 has a channel 120 to receive an attachment pin 122 and is dimensioned and configured to fit and slide within the channels 32 of the rails 24. Each attachment pin 122 is dimensioned and configured (as shown in FIG. 6) for engaging with the channel 120 of the corresponding bearing 116 of the hammer 18 so as to prevent the hammer 18 from wobbling within the channels 32 of the rails 24 when the hammer 18 is sliding along the channels 32 of the rails 24. For the attachment pins 122 to have sufficient durability when making contact with the channels 120 of the bearings 116 of the hammer 18, grease is inserted into the channels 120 of the bearings 116 of the hammer 18 so as to give the attachment pins 122 spring-like properties within the channels 120 of the bearings 116 of the hammer 18. The roller bearing guides 118 help the hammer 18 slide smoothly within the channels 32 of the rails 24. The chamber 106 of the hammer 18 is adapted for receiving weight means 124 (as shown in FIGS. 2 and 3) so that the hammer 18 may exert a greater downward force upon the work piece 12. The weight means or weights 124 are interchangeable and springs 125 having a predetermined stiffness k (N/m) are optional for providing a restoring force or constraining force, particularly when raising or lowering the weights 126. Depending on the application and the need of one having ordinary skill in the relevant art, the stretch length 1 (m) (not shown) of the springs 125 will vary. The maximum stretch length 1 is preferably near the length of the tower 14 to prevent weight extension beyond the frame or support structure. The springs 125 are secured to the foot structure 30 and a bottom portion of the weight 124 via mechanical or clamp fasteners 125*a*, 125*b* and 125*c*, 125*d*. Any number of fasteners can be used to provide similar security within the scope of the intended use of such fasteners.

The hydraulic means for raising and lowering the hammer 18 is a combination of an elongated two-way cylinder 126 and a pulley system 128. The elongated cylinder 126 (as shown in FIGS. 1A, 1B–3 and 9) has an upper end 130, a lower end 132, an inlet 134, and an outlet 136. The elongated cylinder 126 is in an upright position and is parallel with the tower 14. As shown in FIGS. 1A and 1B, the upper end 130 of the elongated cylinder 126 fits within the first opening 38 of the back portion 36. The lower end 132 of the elongated cylinder 126 fits within the first channel 48 of the top side 42 of the receiving structure 28, and is attached to the tower 14 by a fastener (not shown), such as a screw, washer, and nut. The pulley system 128 (as shown in FIGS. 1A, 1B–3) has a pulley 140 and a pulley cable 142 with two ends 144, 146. The pulley 140 is attached to the upper end 130 of the elongated cylinder 126 by a fastener 148, such as a screw, washer, and nut. The pulley cable 142 is positioned, preferably, upon the pulley 140 as best shown in FIGS. 1A and 1B. The first end 144 of the pulley cable 142 is attached to the second opening 40 of the back portion 36, while the second end 146 of the pulley cable 144 is attached to the hole 110 of the abutment 108 of the top side 94 of the hammer 18. The elongated cylinder 126 and pulley system 128 combination reciprocates between a first position (as best shown in FIG. 2) with the pulley 140 being closest to the lower end 22 of the tower 14, and a second position (as best shown in FIG. 3) with the pulley 140 being farthest from the lower end 22 of the tower 14. When the combination is in the second position, the hammer 18 is positioned about the upper end 20 of the tower 14 as shown in FIG. 3.

In a further embodiment, the machine 10 may further include a hydraulic means for tilting the tower 14. The hydraulic means for tilting the tower 14 are two two-way cylinders 150, 152 (as shown in FIGS. 1A, 1B and 8) with each of the two-way cylinders 150, 152 having a first end 154, a second end 156, an inlet 158, and an outlet 160. Each of the ends 154, 156 of the two-way cylinders 150, 152 has a swivel joint 162 (as shown in FIG. 8), which has a channel 164 and is dimensioned and configured to fit within that end 154, 156. The swivel joints 162 permit the tower 14 to be turned laterally.

As shown in FIGS. 1A, 1B and 8, the first ends 154 of the two-way cylinders 150, 152 are attached to the second 50 and third 52 channels of the top side 42 of the receiving structure 28. The attachment of each of the first ends 154 of the two-way cylinders 150, 152 to the receiving structure 28 is accomplished by a fastener 166, such as a locking pin, a washer, and a nut.

As shown in FIGS. 1A and 1B, the second ends 156 of the two-way cylinders 150, 152 are attached to a draw bar 168 by a fastener 170, such as two locking pins. The draw bar 168 has two channels 172 and is attached to the carriage 16 in the position shown in FIGS. 1A and 1B by a fastener 174, such as a plurality of screws, washers, and nuts.

Each of the two-way cylinders 150, 152 reciprocates between a first position (not shown) with the second end 156 of the corresponding two-way cylinder 150, 152 being farthest from the tower 14, a second, or neutral, position (as shown in FIGS. 1A and 1B) with the second end 156 of the corresponding two-way cylinder 150, 152 being second farthest from the tower 14, and a third position (not shown) with the second end 156 of the corresponding two-way cylinder 150, 152 being closest to the tower 14.

When both of the two-way cylinders 150, 152 are in the first position, the tower 14 tilts forward and away from the crane 68. When both of the two-way cylinders 150, 152 are in the second position, the tower 14 is upright and balanced as shown in FIGS. 1A and 1B. When both of the two-way cylinders 150, 152 are in the third position, the tower 14 tilts backward and toward the crane 68. When the first two-way cylinder 150 is in the first position and the second two-way cylinder 152 is in the second or third position, the tower 14 is turned away from the side where the first two-way cylinder 150 is located. When the second two-way cylinder 152 is in the first position and the first two-way cylinder 150 is in the second or third position, the tower 14 is turned toward the side where the first two-way cylinder 150 is located.

The means for transporting hydraulic fluid are preferably a plurality of hydraulic pressurized lines, and a plurality of hydraulic conduits.

Figure 9:
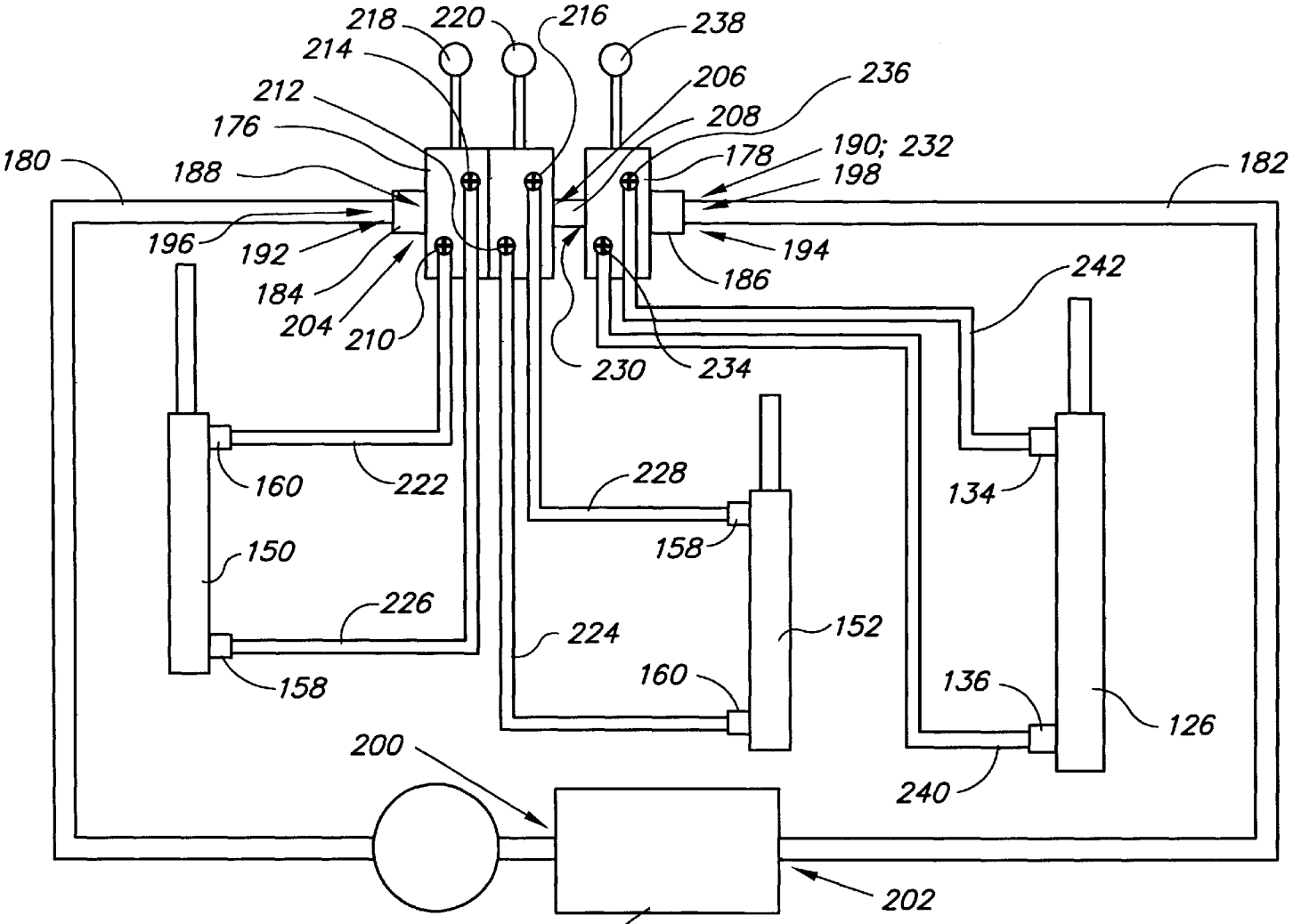
FIG. 9 is a diagrammatic view of a control system for the post driving and earth boring machine according to the present invention.

The means for controlling flow of hydraulic fluid are two control valve boxes 176, 178. The valve boxes 176, 178 (as shown in FIGS. 1A, 1B, 8, and 9) are securely connected to the hydraulic pressurized system of the crane 68 by a feed hydraulic pressurized line 180, a return hydraulic pressurized line 182, a first hydraulic conduit 184, a second hydraulic conduit 186, and by any well known process in the art. As best shown in FIG. 9, each of the first and second conduits 184, 186 has a first end 188, 190 that is dimensioned and configured to securely attach to the corresponding box 176, 178, and a second end 192, 194 that is dimensioned and configured to securely attach to a first end 196, 198 of the corresponding feed 180 or return 182 pressurized line. The pressurized system 179 (as shown in FIG. 9) of the crane 68 is securely connected to second ends 200, 202 of the feed 180 and return 182 pressurized lines.

The first box 176 (as shown in FIGS. 1A, 1B, 8, and 9) includes a bottom opening 204 for receiving the first end 188 of the first conduit 184, and a top opening 206 for receiving a third hydraulic conduit 208. As shown in FIGS. 8 and 9, the first box 176 also includes two inlets 210, 212, two outlets 214, 216, a first lever 218 for controlling fluid flow to the first two-way cylinder 150, and a second lever 220 for controlling fluid flow to the second two-way cylinder 152. As best shown in FIG. 9, each of the inlets 210, 212 of the first box 176 is securely connected to an outlet 160 of the corresponding two-way cylinder 150, 152 by a first 222 or second 224 hydraulic pressurized line, and by any well known process in the art. As best shown in FIG. 9, each of the outlets 214, 216 of the first box 176 is securely connected to the inlet 158 of the corresponding two-way cylinder 150, 152 by a third 226 or fourth 228 hydraulic pressurized line, and by any well known process in the art.

Each of the levers 218, 220 of the first box 176 may be placed in three positions. When either of the levers 218, 220 is in the second, or neutral, position, hydraulic fluid does not flow to the corresponding two-way cylinder 150, 152 of that lever 218, 220 and thereby placing the corresponding two-way cylinder 150, 152 in the second position. When either of the levers 218, 220 is in the first position, hydraulic fluid does flow to the corresponding two-way cylinder 150, 152 of that lever 218, 220 and thereby placing the corresponding two-way cylinder 150, 152 in the first position. When either of the levers 218, 220 is in the third position, hydraulic fluid does flow to the corresponding two-way cylinder 150, 152 of that lever 218, 220 and thereby placing the corresponding two-way cylinder 150, 152 in the third position. The first box 176 is securely connected to the second box 178 by the third conduit 208, and by any well known process in the art.

The second box 178 (as shown in FIGS. 1A, 1B, 8, and 9) includes a bottom opening 230 for receiving the third conduit 208, and a top opening 232 for receiving the second hydraulic conduit 186. As shown in FIGS. 8 and 9, the second box 178 includes an inlet 234, an outlet 236, and a lever 238 for controlling fluid flow to the elongated cylinder 126. The inlet 234 of the second box 178 is securely connected to the outlet 136 of the elongated cylinder 126 by a fifth hydraulic pressurized line 240, and by any well known process in the art. The outlet 236 of the second box 178 is securely connected to the inlet 134 of the elongated cylinder 126 by a sixth hydraulic pressurized line 242, and by any well known process in the art. The lever 238 of the second box 178 may also be placed in a first, second, or neutral, and third positions.

When the lever 238 of the second box 178 is in the second position, the hammer 18 is positioned about midway between the ends 20, 22 of the tower 14. When the lever 238 of the second box 178 is in the first position, the hammer 18 is positioned about the upper end 20 of the tower 14. When the lever 238 of the second box 178 is in the third position, the hammer 18 is positioned about the lower end 22 of the tower 14.

The tower 14 may be tilted clockwise or counterclockwise by removing the fastener 84 attaching the hollow cylinder 66 to the joint 64, and by placing the lever 218, 220 corresponding to the two-way cylinders 150, 152 in the desired position.

The first 176 and second 178 boxes may be positioned in a variety of positions, but it is preferred that the two boxes 176, 178 are attached to one another and to the tower 14 in the positions shown in FIGS. 1A, 1B and 8 by any well known process in the art.

Figure 7:
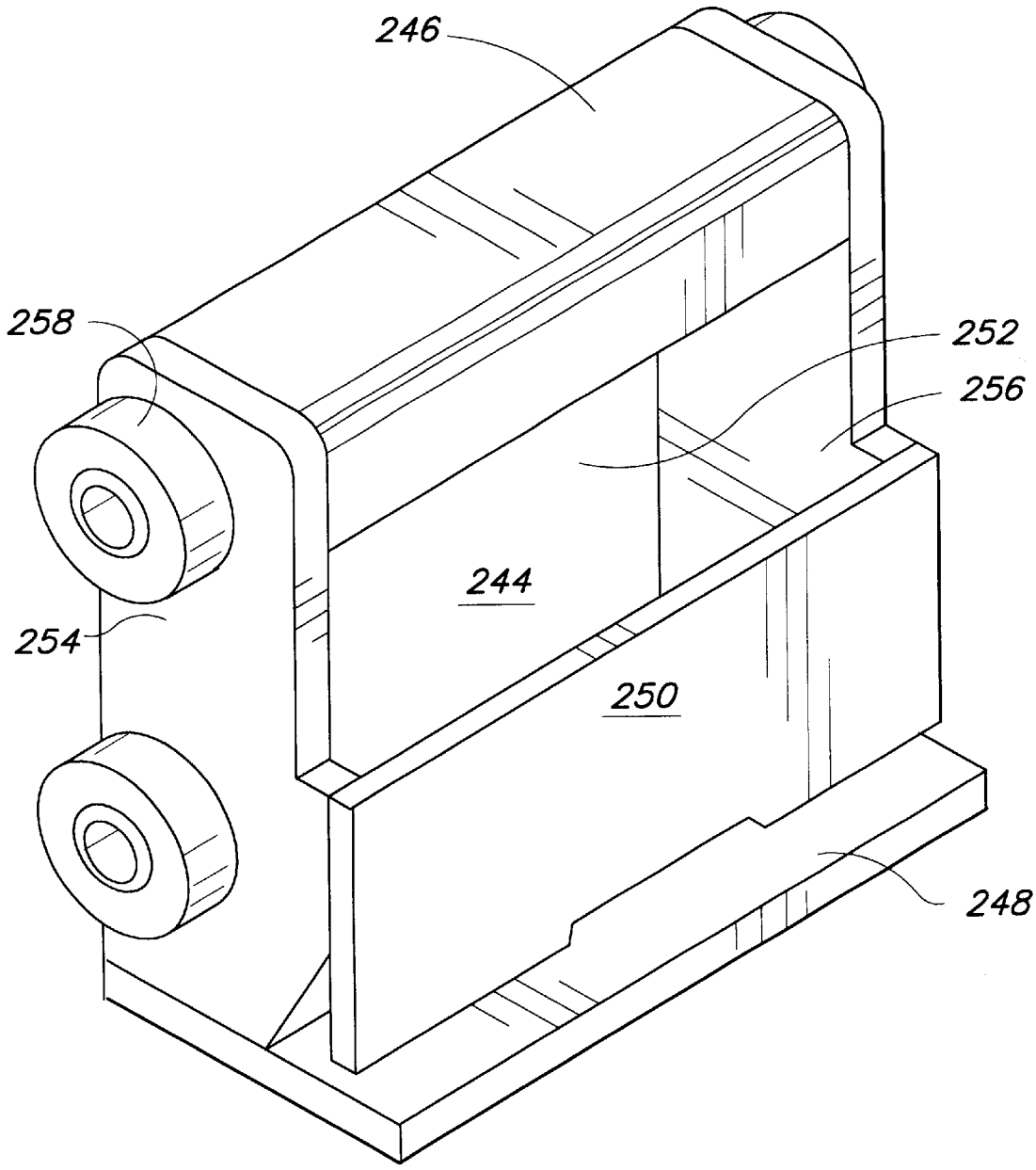
FIG. 7 is a perspective view of a hammer guide for the post driving and earth boring machine according to the present invention.

In an additional embodiment, the machine 10 may include a hammer guide 244. The hammer guide 244 (as shown in FIGS. 2 and 3) is located below the hammer 18 and is dimensioned and configured to fit within the rails 24. The hammer guide 244 (as best shown in FIG. 7) has a top side 246, a bottom side 248, a front side 250, a back side 252, a first side 254, and a second side 256. The purpose of the hammer guide 244 is to provide a dampening means between the hammer 18 and the work piece 12 so that the work piece 12 will not be cosmetically damaged, or only minimally damaged, by the downward force that is exerted by the hammer 18.

The top side 246 of the hammer guide 244 has sufficient rigidity and strength to receive the downward force exerted by the hammer 18. The bottom side 248 of the hammer guide 244 is adapted for attaching the work piece 12, and has sufficient rigidity and strength to exert a substantially equivalent downward force upon the work piece 12 so that the work piece 12 is directed downward towards the work surface. The attachment of the work piece 12 to the bottom side 248 of the hammer guide 244 may be accomplished by any well known process in the art. Each of the first 254 and second 256 sides of the hammer guide 244 has two roller bearings 258, preferably in the positions as shown in FIG. 7. Each of the roller bearings 258 of the hammer guide 244 is dimensioned and configured to fit and slide within the channels 32 of the rails 24.

As shown in FIGS. 2 and 6, the means for attaching the hammer 18 to the hammer guide 244 are a locking pin 260 and a cable 262. As best shown in FIG. 6, the locking pin 260 is dimensioned and configured to fit within the holes 114 of the abutments 112 of the front side 98 of the hammer 18. The locking pin 260 has a lock top 264 that may be adjusted to a locking position so that the locking pin 260 may be secured to the hammer 18 when the cable 262 is attached to the locking pin 260 and to the hammer guide 244.

In another embodiment, the machine 10 may further include an interchangeable plate 266 (as shown in FIGS. 2 and 3) for attaching the work piece 12. The attachment of the interchangeable plate 266, located below the hammer 18 and hammer guide 244, to the work piece 12 may be accomplished by any well known process in the art. The interchangeable plate 266 may be made in a variety of shapes and sizes to accommodate the variety of work pieces 12 that may be used in a work project.

In a further embodiment, the tower 14 may further include two ears 268 for attaching the tower 14 to a structure on the vehicle transporting the tower 14 so that the tower 14 may be transported to and from a work site in a safe manner. The ears 268 are preferably attached to the tower 14 in the positions shown in FIGS. 1A, 1B–3 and 8 by any well known process in the art, such as welding, molding, brazing, soldering, etc.

A preferred method of using the machine 10 for driving posts, drills, large spikes, and the like work pieces 12 into the ground, pavements, or wall structures comprises the steps of:

(a) connecting the hydraulic pressurized system of the crane 68 of the truck 70 to the machine 10 with the feed hydraulic pressurized line 180, the return hydraulic pressurized line 182, the first hydraulic conduit 184, and the second hydraulic conduit 186;

(b) starting the hydraulic pressurized system;

(c) placing the first 218 and second 220 levers of the first box 176 in the desired positions so as to have both of the two-way cylinders 150, 152 in the desired positions;

(d) placing the lever 238 of the second box 178 in the desired position so as to be able to attach the hammer 18 to the hammer guide 244;

(e) attaching the hammer 18 to the hammer guide 244;

(f) placing the lever 238 of the second box 178 in the desired position so as to attach the work piece 12 to the interchangeable plate 266;

(g) attaching the work piece 12 to the interchangeable plate 266;

(h) unattaching the attachment of the hammer 18 to the hammer guide 244;

(i) placing the lever 238 of the second box 178 in the first position so as to raise the elongated cylinder 126 and hammer 18;

(j) placing the lever 238 of the second box 178 in the third position so as to lower the elongated cylinder 126 and permitting the hammer 18 to slide downward and to make contact with the work piece 12; and (k) repeating steps (g) and (h) if necessary.

Other advantages of the post-driving and earth-boring machine 10 includes wherein the capacity for installing specific I-beams affords six, eight or twelve inch I-beams with soil plates. After the I-beams are driven into the soil, preformed concrete wall sections slide in between the I-beams. The wall is securely held by connecting rods across the top and bottom of the concrete form to the I-beams. The concrete form can be removed to clean out debris if necessary. Further advantages, include wherein the erected walls are used to reduce soil erosion, provide privacy, sound barriers and/or traffic barriers, prevent rock slides and snow drifts. Since the machine can operate in sand, it is excellent or ideal for installing walls to prevent beach erosion. The machine 10 also includes many other areas of application such as guardrail installation, installation of piers and docks, fence post installation, test drilling and post puller attachment.

It is to be understood that the present invention is not limited to the sole embodiments described above, but encompasses any and all embodiments within the scope of the following claims.

I claim:

1. A machine for driving posts, drills, large spikes, and like work pieces into the ground, pavements, or wall structures comprising:

an elongated tower including an upper end, a lower end, and two parallel rails, said lower end of said tower is adapted for resting on a work surface, each of said rails having a channel parallel to each of corresponding said rails facing one another, a carriage including a first end and a second end, said first end of said carriage is adapted for attaching to hydraulic means for raising and lowering said tower, said second end of said carriage is adapted for attaching to said tower;

means for attaching said carriage to said tower;

a hammer having a top side, a bottom side, a first side, and a second side, said bottom side of said hammer is adapted for attaching with the work piece, and has sufficient rigidity and strength to exert a sufficient downward force on the work piece, said first and second sides of said hammer are adapted to slide upward and downward within said channels of said rails, wherein said hammer is dimensioned and configured to fit within said rails;

hydraulic means for raising and lowering said hammer having a first end and a second end, wherein said hydraulic means for raising and lowering said hammer is adapted for attaching to said tower;

wherein said hydraulic means for raising and lowering said hammer reciprocates between a first position with said hydraulic means for raising and lowering said hammer being closest to said lower end of said tower, and a second position with said hydraulic means for raising and lowering said hammer being farthest from said lower end of said tower;

means for transporting hydraulic fluid is adapted for connecting securely to said hydraulic means for raising and lowering said hammer and to a hydraulic pressurized system of the hydraulic means for raising and lowering said tower; and means for controlling flow of hydraulic fluid is adapted for connecting securely to said means for transporting hydraulic fluid and to the hydraulic pressurized system of the hydraulic means for raising and lowering said tower.

2. The machine according to claim 1, wherein:

said means for attaching said carriage to said tower is a securing plate and a fastener, said securing plate is adapted to work in conjunction with said fastener to attach said carriage to said tower, and said securing plate having two ends and a length defined between said ends of said securing plate;

wherein said length is sufficient to support the attachment of said carriage to said tower.

3. The machine according to claim 1, wherein:

said hydraulic means for raising and lowering said hammer is a combination of an elongated two-way cylinder and a pulley system, said elongated cylinder has an upper end, a lower end, an inlet, and an outlet, said elongated cylinder is attached to said tower by a fastener, said pulley system has a pulley and a pulley cable with two ends, wherein said pulley is attached to said upper end of said elongated cylinder by a fastener, wherein said elongated cylinder and said pulley system combination reciprocates between a first position with said pulley being closest to said lower end of said tower, and a second position with said pulley being farthest from said lower end of said tower.

4. The machine according to claim 1, wherein:

said means for transporting hydraulic fluid are a plurality of hydraulic pressurized lines, and a first, second, and third hydraulic conduits, each of said conduits having a first end and a second end.

5. The machine according to claim 1, wherein:

said means for controlling flow of hydraulic fluid are a first and second control valve boxes, said first box includes a bottom opening for receiving said first end of said first conduit, a top opening for receiving said third conduit, two inlets, two outlets, a first lever, and a second lever, wherein each of said levers of said first box may be placed in a first, second, and third positions, said second box includes a bottom opening for receiving said third conduit, a top opening for receiving said second conduit, an inlet, an outlet, and a lever for controlling fluid flow to said elongated cylinder, wherein said inlet of said second box is securely connected to said outlet of said elongated cylinder by one of said hydraulic pressurized line, wherein said outlet of said second box is securely connected to said inlet of said elongated cylinder by one of said hydraulic pressurized line, said lever of said second box may be placed in a first, second, and third positions.

6. The machine according to claim 1, wherein:

said lower end of said tower has a foot structure.

7. The machine according to claim 1, wherein:

said tower further including a plate structure and a carriage receiving structure, said plate structure having a front portion and a back portion, wherein said front portion is preferably attached to said rails;

wherein said back portion having two openings, said receiving structure having a top side, a front side, and a back side;

wherein said top side of said receiving structure has three channels;

wherein said front side of said receiving structure is adapted for attaching to said rails;

wherein said back side of said receiving structure has two holes and a receiving channel.

8. The machine according to claim 1, wherein:

said carriage further including a universal joint and a hollow cylinder for receiving said joint, said joint having a plate with three holes, and said hollow cylinder having an inner diameter that is dimensioned and configured to receive said joint, a plate with three holes that is adapted to make contact with said plate of the joint, and two holes proximate said second end of said carriage.

9. The machine according to claim 1, wherein:

each of said first and second sides of said hammer having two roller bearings and a roller bearing guide;

wherein each of said roller bearings of said hammer is dimensioned and configured to fit and slide within said channels of said rails.

10. The machine according to claim 1 further comprising:

hydraulic means for tilting said tower and at least one constraining means having a predetermined stiffness for constraining the weight means within the tower.

11. The machine according to claim 10, wherein:

said hydraulic means for tilting said tower are two two-way cylinders, each of said two-way cylinders having a first end, a second end, an inlet, and an outlet;

wherein each of said ends of said two-way cylinders having a swivel joint;

wherein each of said swivel joint has a channel and is dimensioned and configured to fit within each of said ends; and each of said two-way cylinders reciprocates between a first position with said second end of said corresponding two-way cylinder being farthest from said tower, a second position with said second end of said corresponding two-way cylinder being second farthest from said tower, and a third position with said second end of said corresponding two-way cylinder being closest to said tower.

12. The machine according to claim 1 further comprising:

a hammer guide having a top side, a bottom side, a front side, a back side, a first side, and a second side, said top side of said hammer guide having sufficient rigidity and strength to receive the downward force exerted by said hammer, said bottom side of said hammer guide is adapted for attaching with the work piece, and having sufficient rigidity and strength to exert a substantially equivalent downward force upon the work piece so that the work piece is directed downward towards the work surface, and each of said first and second sides of said hammer guide having two roller bearings;

wherein each of said roller bearings of said hammer guide is dimensioned and configured to fit and slide within said channels of said rails.

* * * * *